US006119957A

United States Patent [19]

Liu

[11] Patent Number: 6,119,957

[45] Date of Patent: Sep. 19, 2000

[54] INTERMITTENT ARTIFICIAL FOUNTAIN APPARATUS

[76] Inventor: Xu Liu, Klaragase 24, D-90402 Nuremberg, Germany

[21] Appl. No.: 09/366,398

[22] Filed: Aug. 3, 1999

[30] Foreign Application Priority Data

Aug. 4, 1998 [DE] Germany ..... 298 13 951 U

[51] Int. Cl.[7] ..... B05B 17/08

[52] U.S. Cl. ..... 239/17; 239/23; 239/99; 239/583; 4/496

[58] Field of Search ..... 239/11, 12, 17, 239/20, 23, 99, 97, 219, 255, 263.1, 265, 553, 583, 585.1, 211; 4/496

[56] References Cited

U.S. PATENT DOCUMENTS

| | | | |
|---|---|---|---|
| 3,497,185 | 2/1970 | Dively | 239/12 |
| 3,622,074 | 11/1971 | Frohwerk | 239/23 |
| 3,814,318 | 6/1974 | Michaelis | 239/23 |
| 3,889,880 | 6/1975 | Hruby, Jr. | 239/18 |
| 4,512,514 | 4/1985 | Elcott | 239/99 |
| 4,978,066 | 12/1990 | Fuller et al. | 239/12 |
| 4,981,622 | 1/1991 | Nigrelli et al. | 239/23 |
| 5,161,740 | 11/1992 | Kuykendal et al. | 239/23 |
| 5,163,615 | 11/1992 | Bauer | 239/12 |
| 5,249,744 | 10/1993 | Ruthenberg | 239/23 |
| 5,480,094 | 1/1996 | Fuller et al. | 239/17 |
| 5,553,779 | 9/1996 | Fuller et al. | 239/17 |
| 5,727,733 | 3/1998 | Ruttenberg | 239/99 |
| 5,931,382 | 8/1999 | Gross et al. | 239/17 |
| 5,979,791 | 11/1999 | Kuykendal et al. | 239/99 |

*Primary Examiner*—Andres Kashnikow
*Assistant Examiner*—Jorge Bocanegra
*Attorney, Agent, or Firm*—Brown & Wood, LLP

[57] ABSTRACT

An intermittent artificial fountain apparatus to be installed in a water pool and including a spraying body formed as a waterproof structure having a sealed cavity, a light floating structure surrounding the spraying body, a spraying tube arranged in the spraying body co-axially therewith and having a spraying opening to be located above a water level of the pool, a piston formed of a ferromagnetic material and arranged in the spraying tube for a reciprocating movement therein to provide for filling of the spraying tube with water and for spraying the water received in the spraying tube outwardly upon movement of the piston in an opposite direction, an electromagnetic structure cooperating with the piston for effecting movement of the piston in one of the opposite directions, a pulse signal generator to be connected to an external power source and connected with the electromagnetic structure, and return element for moving the piston in another of the opposite directions.

7 Claims, 1 Drawing Sheet

INTERMITTENT ARTIFICIAL FOUNTAIN APPARATUS

BACKGROUND OF THE INVENTION

1. Field of the Invention

The present invention relates to a small-scale intermittent fountain apparatus operating on the electromagnetic principle.

2. Description of the Prior Art

It is well known that the provision of an artificial fountain apparatus in a pool is a popular way for beautifying the environment. However, up to now, most of such apparatuses are large scale specialized arrangements. There does not yet exist a small-scale intermittent fountain apparatus with simple structure suitable for family or a small scale pool.

Accordingly, the object of the present invention is to provide a small-scale intermittent artificial fountain apparatus operating on the electromagnetic principle.

SUMMARY OF THE INVENTION

This and other objects of the present invention, which will become apparent hereinafter, are achieved by providing an intermittent artificial fountain apparatus including a spraying body in combination with a light floating structure fitted around the spraying body. The light floating structure can be made of a light porous foamed material, such as foam plastics, sponge, etc., which does not sink due to water self-suction, or of gas filled structure, such as gas bag in suitable manner or shape. The light floating structure can have a discretely or continuously surrounding shape. In order to conveniently regulate the floating height of the whole apparatus in the water, it is preferable to adopt a kind of connection, by means of which the axial fitting position of the floating structure with the spraying body is controllable. The spraying body is a structure of waterproof sealed cavity, inside of which a spraying tube is axially arranged. The spraying tube has a water spraying opening which is connected with the outside. A simpler and easier way of providing the spraying tube is to use a structure in the shape of a through-tube. Inside the spraying tube there is provided a ferromagnetic piston structure or a piston formed of a ferromagnetic material in the clearance fitting, which can reciprocate inside the tube wall and is combined with a returning flexible structure. When the spraying tube is formed as a through-tube structure, at the rear end, there should be provided a position limiting structure having suitable configuration for supporting the piston structure inside the tube. The returning flexible structure in combination with the piston structure can be fixedly connected to or can freely move inside the spraying tube. Adjacent the outside periphery of the spraying tube, there is provided an electromagnetic structure capable of cooperation with the piston structure comprising ferromagnetic material. There is also provided a pulse signal generator which is connected to an external power source, and can be electrically connected with the electromagnetic structure. The electromagnetic structure, which is provided adjacent the spraying tube, can be formed as an electromagnetic structure set consisting of several separated and spaced apart electromagnetic structures, or as a cylindrical and integral electromagnetic structure surrounding the outside periphery of the spraying tube. The pulse signal generator for providing intermittent pulse current to the electromagnetic structure can be selected from the known pulse signal generators, such as the one working on the principle of condenser discharge and charge or other principles, if desired. Various conventional power sources, such as battery, accumulator cell, solar cell and rectified AC power source, can be adopted as the external power source according to the practice and requirement.

An electromagnetic structure which is provided outside of the spraying tube, enables the movement of the piston structure, which comprises ferromagnetic material and is located inside the spraying tube, in the spraying tube under the electromagnetic force generated by the electromagnetic structure after the electromagnetic structure is actuated. The pulse signal generator provides intermittent current to the electromagnetic structure, and an intermittently driving action can be generated for the piston structure provided inside the spraying tube. Under the cooperation with the respective returning flexible structure such as return spring, the piston structure can be reciprocated inside the spraying tube so as to alternatively aspirate the surrounding pool water through the spraying opening, and to pump and spray the water again from the spraying opening which forms an intermittent spraying fountain. Dependent on the pulse signal frequency which controls the supply of the current, the pumping and spraying frequency of the present fountain apparatus can also be varied correspondingly. If the diameter of the spraying tube varies, the shape of the pumped and sprayed water column, such as height, diameter, etc . . . , will be different.

Though pool water can enter into the spraying tube through the spraying opening, however, when there are sundries floating over the water surface, they can gather at/or even block the spraying opening. Therefore, in addition to the provision of suitable filtering structure, such as filter gauze, filter grating, at the spraying opening, the spraying opening is configured as an extended nozzle protruding to the surface of the spraying body, where it is located. The formation of the spraying opening as an extended nozzle permits the spraying opening to be exposed above the water surface. At the same time, at the suitable position of the extended nozzle periphery, a water inlet is provided to communicate with the spraying tube, and at the position corresponding to the water inlet, a cover for the water inlet is provided inside the spraying tube. The cover is connected to the piston structure by a suitable connection means, such as returning flexible structure or linkage, so that it can move synchronously and co-directionally therewith. This allows to effect the water injection and spraying at different portions of spraying opening, respectively. That is, water can be injected only through the water inlets, and during spraying, the piston structure performs pumping movement, as well as closes the water inlets at the same time, therefore the water inside the tube can be pumped out only from the nozzle. At that time, the water inlets can be located under the water surface. It is beneficial to avoid the influence of the sundries floating over the water surface. Besides the filtering structure of suitable shape provided outside the water inlets, at the portions of the light floating structure, such as its periphery or lower face, outside the spraying body, some suitable water inlet channels, such as duct, tube, can also be provided for connection with the water inlets, in order that the water injected into the spraying tube can come from a deeper position below the water surface as much as possible where the influence of floating sundries is smaller.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments when read with reference to the accompanying drawings.

DETAILED DESCRIPTION OF THE PREFERRED EMBODIMENT

Figure 1:
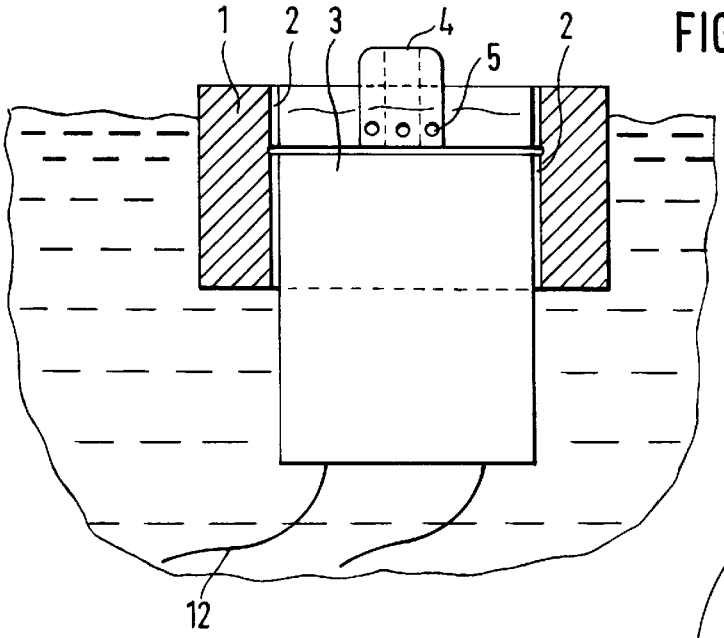
FIG. 1 is a schematic view showing the general structure of a new type fountain apparatus according to the present invention.
Figure 2:
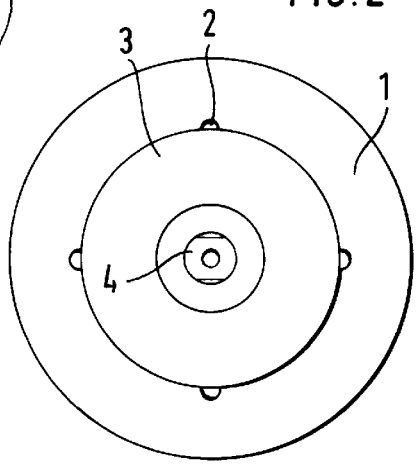
FIG. 2 is a top view of the apparatus shown in FIG. 1.
Figure 3:
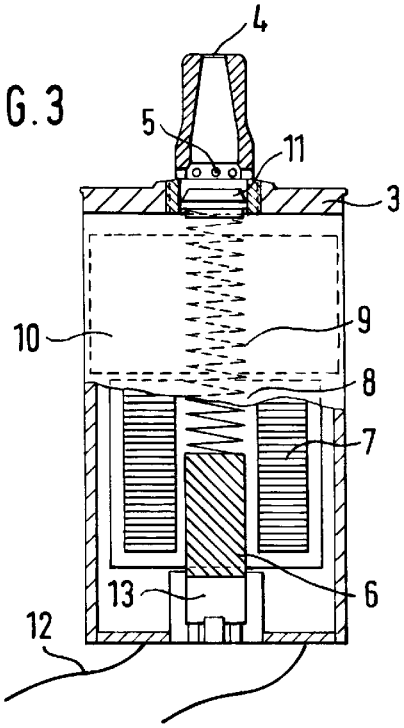
FIG. 3 is a cross-sectional view showing a piston provided inside the spraying tube of the apparatus under the water injection condition.
Figure 4:
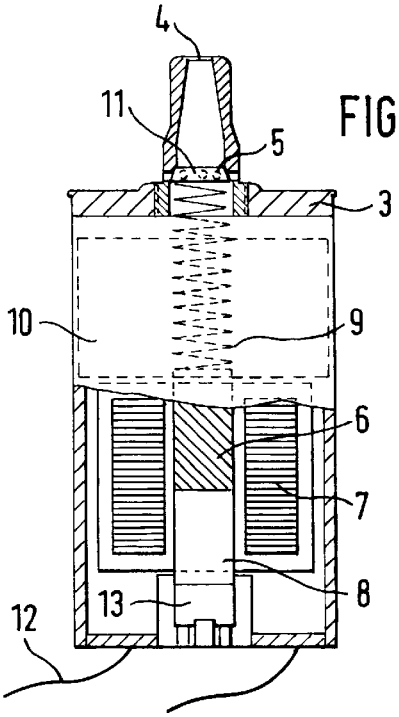
FIG. 4 is a cross-sectional view showing the piston provided inside the spraying tube under the pumping and spraying condition.

As shown in the drawings, an intermittent artificial fountain apparatus according to the present invention consists of a spraying body 3 in combination with a cylindrical floating body 1 which is fit tightly around the outer-surface of the spraying body 3 and is made of a light foamed material. A floating height of the whole apparatus in the water can be regulated by varying the axial fitting position of the floating body 1 outside the spraying body 3. In the interior side of the floating body 1, which contacts the spraying body 3, through-channels 2 for water inlet are provided. The spraying body 3 is a cylindrical structure having a waterproof sealed cavity. A through-spraying tube 8 having a water spraying opening 4 which is connected with the outside, is provided, along the axis of the spraying body, at its rear end, with a position limiting structure 13 which has a shape of a supporting platform, for supporting a piston 6 of an electromagnetic material, which is located inside the spraying tube 8 and can be reciprocated along inside wall of spray tube 8. The limiting structure 13 limits an excessive downward movement of the piston. The water spraying opening 4 formed as an extended nozzle having a tapered end and protruding to the surface of its spraying body 3. In the periphery adjacent the root of the nozzle, several water inlets 5 are provided for communication with the spraying tube 8. In operation, it is preferable to maintain the nozzle and mouth of the spraying opening 4 exposed above the water level by regulating the axial position of the floating body 1 relative to the spraying body 3. Inside the spraying tube 8, a compression spring 9, which serves as a return spring, which can reciprocate freely, is provided. The end of the spring adjacent the spraying opening 4 is connected with a cover 11 for closing the water inlets 5 at the spraying opening, while the opposite end remote from the spraying opening is supported against the piston 6. Around the outside periphery of the spraying tube 8, there are provided a cylindrical electromagnetic structure 7 which can be combined with the piston 6, and a pulse signal generator 10 which can be electrically connected with the electromagnetic structure 7, by a wire 12, and connected to suitable DC power source, such as solar cell board.

In operation, the above-mentioned fountain apparatus is set in a pool to float freely. The axial position of the floating body 1 outside spraying body 3 is regulated in order to expose the nozzle end mouth of the spraying opening 4 above the water level. The pool water at the deeper position below the floating body 1 can be injected into the spraying tube 8 through the water inlet channel 2 between the floating body and the spraying body. In response to that, the power source is turned on, and the pulse signal generator 10 continuously provides the intermittent pulse current for the electromagnetic structure 7. The piston 6 can reciprocate inside the spraying tube 8 in cooperation with the compression spring 9, and the cover 11 of the water inlet, which is located at the other end of the spring, is moving simultaneously and co-directionally with the spring 9. That is, when the piston 6 moves downwardly under action of the spring, the water inlet cover 11 drops too, water inlets 5 become open, and the pool water can inject into the spraying tube. When the piston 6 moves upwardly under the action of the electromagnetic force, the cover 11 is driven upwardly by the spring at the same time and closes the water inlets 5 enabling the water injected into the spraying tube only to be pumped and sprayed out upwardly as a fountain through the nozzle spraying opening 4. Though the present invention has been shown and described with reference to a preferred embodiment, such is merely illustrative of the present invention and is not to be construed as to be limited to the disclosed embodiment and/or details thereof, and the present invention includes all modifications, variations and/or alternate embodiments within the spirit and scope of the present invention as defined by the appended claims.

What is claims is:

1. An intermittent artificial fountain apparatus to be installed in a water pool, comprising:

a spraying body formed as a waterproof structure having a sealed cavity;

a light floating structure surrounding the spraying body;

a spraying tube arranged in the spraying body co-axially therewith and having a spraying opening to be located above a water level of the pool;

a piston formed of a ferromagnetic material and arranged in the spraying tube for a reciprocating movement therein to provide for filling of the spraying tube with water upon movement of the piston in one direction and for spraying the water received in the spraying tube outwardly upon movement of the piston in an opposite direction;

electromagnetic means for effecting movement of the piston in one of the one direction and the opposite direction and including an electromagnetic structure cooperating with the piston and a pulse signal generator to be connected to an external power source and connected with the electromagnetic structure; and return means for moving the piston in another of the one direction and the opposite direction.

2. The intermittent artificial fountain apparatus of claim 1, wherein the spraying tube is formed as a through-tube, and wherein there is provided, at an end of the spraying tube opposite to the spraying opening, means for supporting the piston.

3. The intermittent artificial fountain apparatus of claim 1, further comprising an elongate nozzle associated with the spraying tube and defining the spraying opening, the nozzle having, in a circumferential surface thereof, inlet means communicating with the spraying tube; and a cover for closing the inlet means and located in the spraying tube interior and movable synchronously and co-directionally with the movement of the piston.

4. The intermittent artificial fountain structure of claim 3, wherein the return means comprises a compression spring member located in the spraying tube interior and supported against the piston, and wherein the closing cover is provided an end of the spring member remote from the piston.

5. The intermittent artificial fountain apparatus of claim 3, further comprising water inlet channels provided between the light floating structure and provided a side surface of the nozzle which the water inlets are formed.

6. The intermittent artificial fountain apparatus of claim 1, wherein the electromagnetic structure is formed as a cylindrical tube structure surrounding an external periphery of the spraying tube.

7. The intermittent artificial fountain apparatus of claim 1, wherein the light floating structure is formed of a light foamed material and has a tubular shape.

* * * * *